US005613250A

United States Patent [19]

Bell

[11] Patent Number: 5,613,250

[45] Date of Patent: Mar. 25, 1997

[54] LEG, ANKLE, AND FOOT APPAREL PROTECTOR

[76] Inventor: Ronald V. Bell, 12420 Incline Dr., Auburn, Calif. 95603

[21] Appl. No.: 692,709

[22] Filed: Aug. 6, 1996

[51] Int. Cl.[6] ..... A41D 17/02

[52] U.S. Cl. ..... 2/242; 2/22; 2/46; 36/2 R

[58] Field of Search ..... 2/242, 46, 22, 2/23, 61, 239; 36/1.5, 2 R, 7.2, 131

[56] References Cited

U.S. PATENT DOCUMENTS

| | | | |
|---|---|---|---|
| Re. 13,747 | 6/1914 | Woodward | 2/61 |
| D. 306,921 | 3/1990 | Pettinelli | D29/10 |
| D. 365,667 | 12/1995 | Hargrove et al. | D29/120 |
| 1,363,348 | 12/1920 | Prince | 36/7.2 |
| 1,621,153 | 3/1927 | Bunnenberg | 2/242 |
| 2,249,553 | 7/1941 | Cataffo | 2/22 |
| 2,657,477 | 11/1953 | Winslow | 36/2 R |
| 2,717,387 | 9/1955 | McMahan | 2/22 |
| 3,128,565 | 4/1964 | Graham et al. | 2/242 |
| 3,304,629 | 2/1967 | Meyers | 36/2 R |
| 4,497,070 | 2/1985 | Cho | 2/22 |
| 4,503,566 | 3/1985 | Wheeler | 2/22 |
| 4,665,562 | 5/1987 | Winer | 2/22 |
| 4,665,633 | 5/1987 | Edgerton | 36/2 R |
| 5,031,247 | 7/1991 | Carter | 2/242 |
| 5,172,493 | 12/1992 | Diaz | 36/2 R |
| 5,469,637 | 11/1995 | Adam | 36/2 R |

FOREIGN PATENT DOCUMENTS

| | | | |
|---|---|---|---|
| 56689 | 2/1944 | Netherlands | 2/23 |
| 257389 | 4/1949 | Switzerland | 2/242 |
| 270808 | 12/1950 | Switzerland | 2/242 |
| 434512 | 9/1935 | United Kingdom | 36/7.2 |

OTHER PUBLICATIONS

McMaster–Carr Advertisement, "Spats and Leggings".

*Primary Examiner*—Amy B. Vanatta

[57] ABSTRACT

A leg, ankle, and foot apparel protector including a leg cover piece, a shoe cover piece, and a sole piece; the leg cover piece having a generally rectangular shape with longer vertical edges of equal lengths and a shorter horizontal upper edge, while having an inward arcing lower horizontal edge; the shoe cover of a generally tapered shape with vertical edges converging to a rounded tip at the bottom and having an upper horizontal edge of an inward curving arc; the sole being half-moon shaped to fit under the forward tip of a shoe and joining to the underneath lower end of the shoe cover to form a toe pocket; the leg cover having a strap attached horizontally to the upper vertical edge of the leg cover and having means of fastening the strap; the shoe cover having a strap attached at about a forty-five degree upward angle to the upper vertical edge of the shoe cover and having a means of fastening the strap; the strap for the shoe cover also supplying ample tension on the toe pocket to hold the toe pocket in place while the leg, ankle, and foot apparel protector is worn.

1 Claim, 3 Drawing Sheets

LEG, ANKLE, AND FOOT APPAREL PROTECTOR

BACKGROUND—FIELD OF INVENTION

This invention relates to externally worn devices which protect the wearer's apparel related to the lower leg, ankle, and foot.

BACKGROUND—DISCUSSION OF PRIOR ART

Protective devices for clothing and shoes are common. There has always been a need to protect clothing from adverse elements. Raincoats protect clothing from moisture. Aprons help to keep clothing unsoiled. Overshoes, gaiters, and spats keep shoes dry. In addition, spats and leggings exist in the market place which are designed to protect the worker's leg and foot apparel from molten metal, flames, and sparks.

Other devices protect clothing from a number of specific hazards. One such device is the leg protecting apparatus in U.S. Pat. No. 4,665,562 to Winer, 1986 October 6. Winer's apparatus includes a generally rectangular sheet of material designed to be positioned on the inside calf and ankle of a bicyclist. Winer's apparatus fits on the one leg of the rider which is next to the bicycle chain to prevent grease and soil from transferring onto the rider's pant leg. Another such device is the shoe top cover in U.S. Pat. No. 4,665,633 to Edgerton, 1986 September 26. Edgerton's device covers the shoe top to protect it from paint splashes. It consists of a fabricated piece of moisture resistant material shaped to fit around the ankle and over the front and back of a shoe.

People who operate motorized string trimmers, lawn mowers, tillers, and other such equipment have had very little protection from the dirt and debris that is thrown off by lawn equipment. Their pant legs, socks, and shoes are at the mercy of flying debris. Normally, those who use lawn equipment simply accept the annoying grit and debris which becomes imbedded in pant legs, socks, shoes, and shoestrings. Shoes and pants can be stained and may even be ruined. Debris can become so imbedded in socks that even after several washings itchy and annoying particles can still be found trapped in the fiber. Shoestrings can become saturated with grit, burrs, and bits of weed and grass straw.

One prior-art is known to exist which attempts to solve some of these problems. The leg protector in U.S. Pat. No. 5,031,247 to Carter, 1991 July 16, provides partial protection from the flying debris created by common lawn and garden equipment. However, Carter's tubular leg protector falls short in a number of ways:

(a) The need to protect the entire top of the foot is not anticipated by Carter. The lower edge of Carter's tubular leg protector sits on top of the arch of the foot. This leaves the entire forward portion of the shoe unprotected. The problem of annoying debris which stains shoes and is embedded into shoestrings is not solved.

(b) Carter's invention does not adequately protect ankle apparel or the top of the shoe. The lower fasteners of Carter's tubular, wrap-around leg protector are not designed to close around the ankle tight enough to prevent violently flung debris from finding its way under the lower edge. Such debris has no trouble compromising the lower edge to become lodged in one's socks, shoes, and shoelaces. If, instead, one were to tighten the lower edge enough to seal it closely around the ankle, the entire shoe top and shoestrings would be fully exposed. Either way, soiling is inevitable on one or more of these items of apparel.

(c) Carter's wrap-around, tubular leg protector limits the movement of the wearer. His design calls for the upper horizontal edge of his invention to close two or three inches above the knee. The free and easy movement of the knee is impaired.

(d) Carter's leg protector can cause discomfort. His leg protector is made of a sheet of rectangular material which fully encases the lower leg. This holds in body heat. Since most lawn and garden work is done during the warmer months, this is a serious consideration.

In addition, the leg protector in U.S. Pat. Design No. 365,667 to Hargrove and Winston, 1995 December 26, depicts an ornamental design for a leg protector. As is proper, Hargrove and Winston make no claim as to the function of their design. It could serve any number of purposes. Therefore, if their design is adapted for use with lawn equipment it has serious shortcomings. The lower piece or flap lays loosely or unsecured on top of the foot. Therefore, flying debris has no trouble getting up under this flap to embed itself in shoestrings and socks. The need to cover the forward part of the shoe is not considered. The flap stops short of the shoe tip. Grass and weed straw can easily soil and stain the shoe tip. It appears to have excessive weight due to the ornamental second layer which is held in position by a number of snaps. The straps on their leg protector make it difficult to put on and take off. Though the leg protector's function is not at issue, it nevertheless proves to be inadequate if it is used as a leg, ankle, and foot protector.

OBJECTS AND ADVANTAGES

Accordingly, several objects and advantages of my invention are:

(a) to provide a leg, ankle, and foot apparel protector which protects the wearer's apparel from the flying debris that is commonly thrown off by motorized string trimmers, lawn mowers, tillers, and other lawn and garden equipment;

(b) to provide a leg, ankle, and foot apparel protector which protects the shoe tip from the flying debris associated with lawn equipment. Carter (1991) and Hargrove and Winston (1995) do not anticipate the need to protect the forward portion of one's shoe. Therefore, the present invention is designed to go beyond prior art to meet this need. The present invention solves a problem previously unrecognized or considered in prior art;

(c) to provide a leg, ankle, and foot apparel protector which protects the shoe top and shoestrings from flying debris thrown off by string trimmers and other lawn equipment. Carter (1991) and Hargrove and Winston (1995) fail to design leg protectors which keep violently flung debris from compromising the lower edges of their devices. The present invention's shoe tip pocket effectively solves this problem;

(d) to provide a leg, ankle, and foot apparel protector which covers the front half of the lower leg, ankle, and foot, while remaining open on the back portions of the leg, ankle, and foot. This keeps the wearer comfortable while working outdoors during warm seasons. Carter's prior art wrap-around feature fails to provide the comfort necessary to the wearer during warm times of the year;

(e) to provide a leg, ankle, and foot apparel protector which allows smooth and unrestricted movement of the wearer's legs. Carter's prior-art fails to allow ease of movement due to its tubular, over-the-knee design;

(f) to provide a leg, ankle, and foot apparel protector which is easy to put on and take off and can be worn on the outside of one's apparel related to the lower leg, ankle, and foot;

(g) to provide a leg, ankle, and foot apparel protector which is light-weight and economical;

(h) to provide a leg, ankle, and foot apparel protector which will become an added piece of the lawn and garden worker's protective wear;

(i) to provide a leg, ankle, and foot apparel protector which looks good on the wearer;

(j) to provide a leg, ankle, and foot apparel protector which is salable, finding a large market unrestricted by region of the country;

(k) to provide a leg, ankle, and foot apparel protector which can be easily manufactured to fit all sizes and both genders.

Further objects and advantages will become apparent from a consideration of the ensuing description and drawings.

DRAWING FIGURES

REFERENCE NUMERALS IN DRAWINGS

Figure 1:
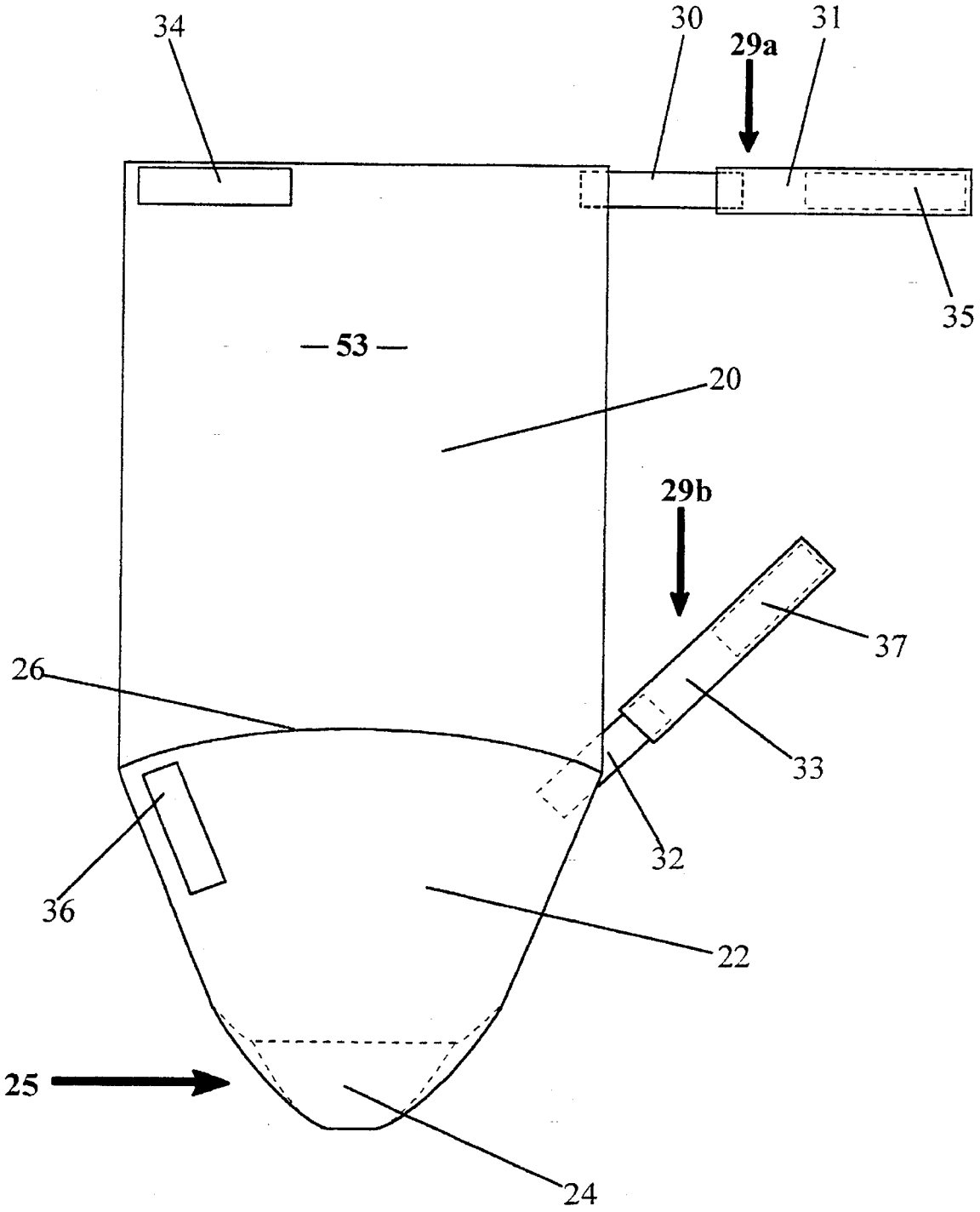
FIG. 1 shows an outside or top view of the leg, ankle, and foot apparel protector laid flat.

In the drawings, similar items are assigned the same number but have different alphabetical suffixes.

53 leg, ankle, and foot apparel protector
20 leg cover
22 shoe cover
24 sole
25 toe pocket
26 seam
**29*a*** upper strap assembly
**29*b*** lower strap assembly
30 elastic strip
31 material strip
32 elastic strip
33 material strip
34 fastener patch
35 fastener patch
36 fastener patch
37 fastener patch

SUMMARY

This present invention is comprised of three pieces joined together to form a device which can be worn over the front of a lower pant leg and shoe. The two larger pieces cover the leg and shoe, while the smaller piece attaches under the tip of the shoe cover piece to form a pocket for the tip of a shoe. Two straps and the toe pocket hold the device in place.

Figure 2:
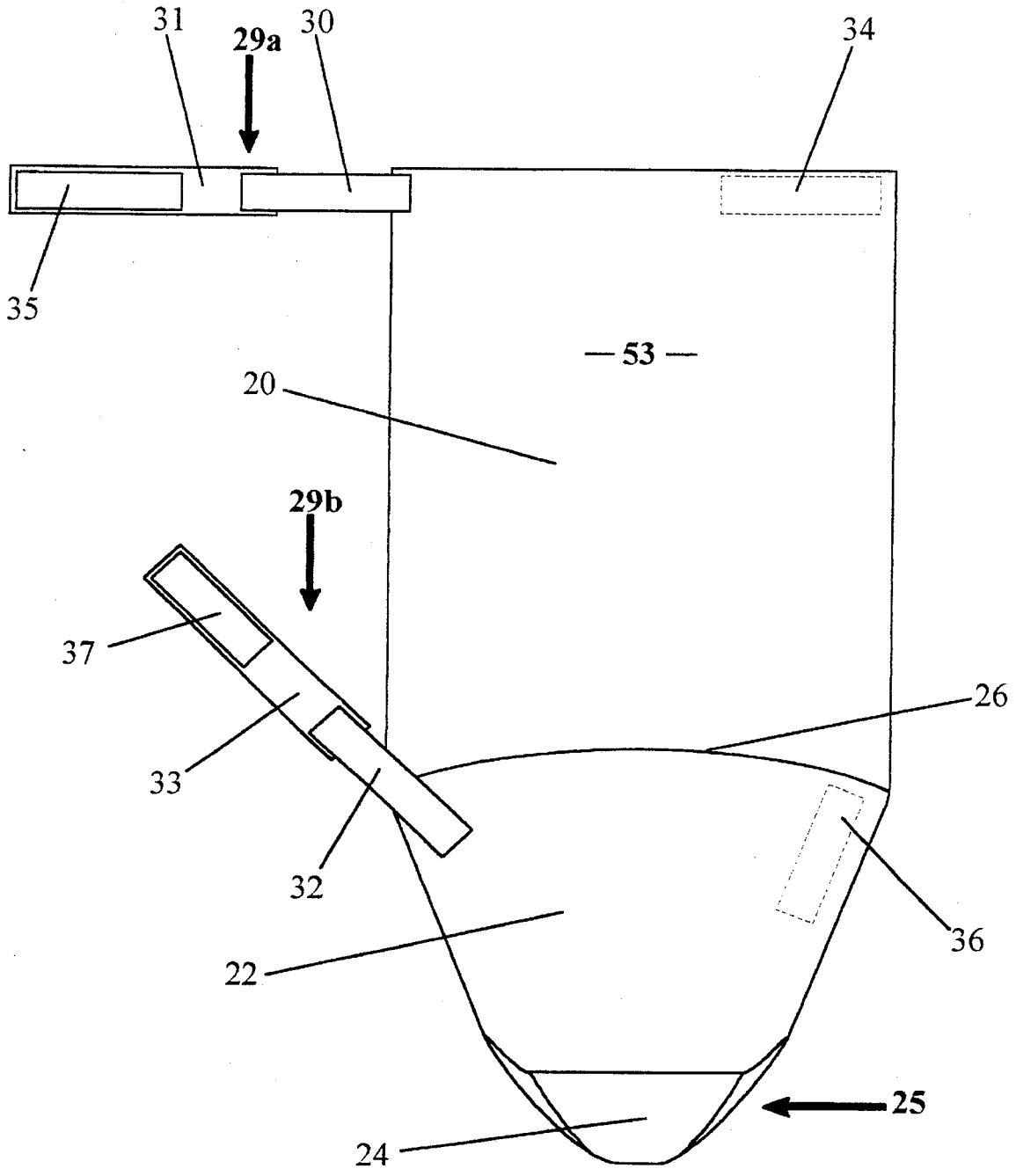
FIG. 2 shows an inside or bottom view of the protector laid flat. It is the opposite, or flip-side, of that shown in FIG. 1.
Figure 3:
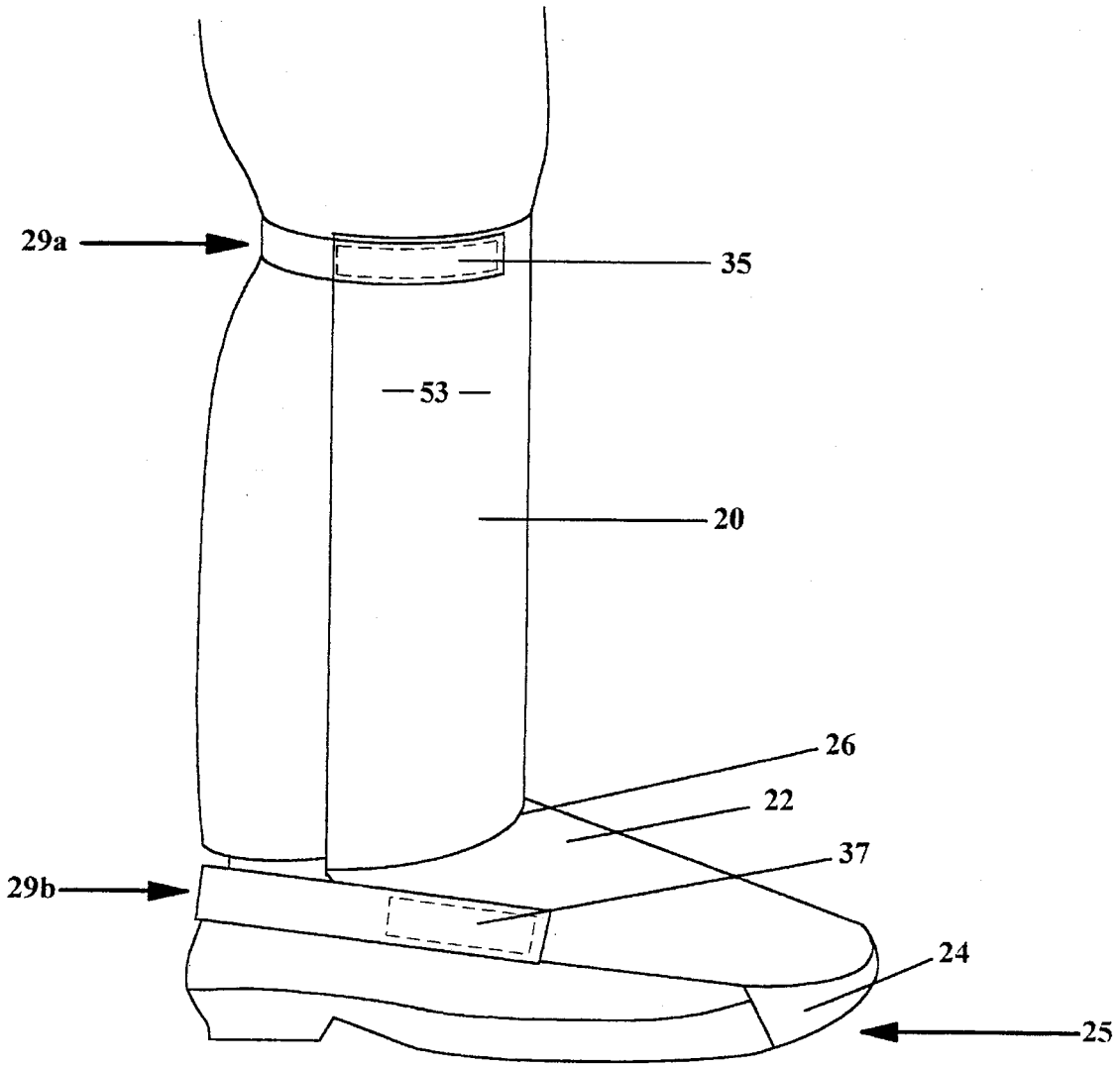
FIG. 3 shows a side view of the leg, ankle, and foot apparel protector as it is worn.

DETAILED DESCRIPTION—FIG. 1 to 3

A typical embodiment of the present invention is illustrated in FIG. 1. All dimensions provided herein are for a leg, ankle, and foot apparel protector 53 which is fashioned to fit a small adult's leg, ankle, and foot. Dimensions for other sizes of protector 53 can easily be extrapolated from the dimensions given here. Protector 53 is formed out of readily available fabric and possesses a generally rectangular shape. Protector 53 is approximately fifty-two to fifty-five centimeters long and twenty-two to twenty-four centimeters at its widest point. A leg cover 20 comprises the top portion of the main body of protector 53. A shoe cover 22 comprises the lower portion of the main body of protector 53. Protector 53 maintains its rectangular shape from the upper horizontal edge to a seam 26, located about thirty-four centimeters below the top edge. Protector 53 tapers to a rounded lower edge beginning at seam 26. Seam 26 is the joining point of leg cover 20 and shoe cover 22. An upper strap assembly **29*a* attaches to the upper right, vertical edge of leg cover 20. Strap 29*a* is approximately twenty to twenty-two centimeters long and about two-and-a-half centimeters wide. A lower strap assembly 29*b* is attached at about a forty-five degree upward angle in the proximity of seam 26 on the right side of protector 53. Strap 29*b* is approximately thirteen to fifteen centimeters long and about two-and-a-half centimeters wide. FIG. 1 shows a sole 24 attached to shoe cover 22 at the lower, rounded edge of shoe cover 22. FIG. 2 illustrates that sole 24 is attached on the reverse or underneath side of shoe cover 22. Only the round edge of sole 24 is attached to shoe cover 22. The straight edge of sole 24 is not attached, sewn, or joined to shoe cover 22 in any way. This forms a toe pocket 25 at the underneath tip of shoe cover 22**.

The generally rectangular shape of leg cover 20 is stitched to the smaller shoe cover 22. Leg cover 20 and shoe cover 22 are made of separate pieces of material. Seam 26 is created by stitching the bottom, arced edge of leg cover 20 to the upper, arced edge of shoe cover 22. The arc cut into leg cover 20 is made on its lower, horizontal edge. The shallow arc thus taken curves upward into the body of material comprising leg cover 20. The arc cut into shoe cover 22 is made on its upper, horizontal edge. The shallow arc taken in shoe cover 22 curves or arcs downward into the body of the material comprising shoe cover 22. The degree of the arc cut into leg cover 20 and shoe cover 22 is identical. From FIG. 3 the arcing of seam 26 is shown to form a proper fit over the arch of the foot. In addition, seam 26 creates a bend or angle in protector 53 which allows it to follow the natural contour of the leg and foot. The bend created by seam 26 also allows leg cover 20 to conform easily to the shin while allowing shoe cover 22 to be held securely on top of the foot by toe pocket 25, aided by strap **29*b***.

FIG. 3 illustrates the placement and function of toe pocket 25, formed by the joining of the generally half-moon shaped sole 24 to the underneath, rounded tip of shoe cover 22. The size of toe pocket 25 is determined by the size of an average shoe tip that will fit into pocket 25. To fit a small shoe tip, the straight edge of sole 24 should be approximately ten to eleven centimeters wide. The depth of sole 24 from the center of its straight edge to the center of its rounded edge should be about six centimeters. The width and depth of sole 24 largely determines the dimensions of toe pocket 25. The depth of sole 24 should be enough to secure toe pocket 25 to the bottom forward tip of a shoe, while leaving the ball of the foot free for traction. Toe pocket 25 should not be so deep that the wearer is caused to walk on the material of sole 24 rather than on the shoe's own tread.

In addition, fastener patches 34 and 36 are stitched or otherwise attached onto the front, left side of the main body of protector 53. Placement of these two fasteners (34 and 36) will cause them to coincide with fasteners 35 and 37 located on strap assemblies 29*a* and 29*b*, respectively. Fasteners 34, 35, 36, and 37 are all comprised of hook and loop material in the present embodiment. Fasteners 34 and 36 connect with fasteners 35 and 37, respectively, when protector 53 is worn.

Fastener 34 is attached horizontally to leg cover 20 at the upper, left-hand corner of leg cover 20 as illustrated in FIG. 1. Fastener 34 should be about ten to eleven centimeters long and approximately two centimeters wide. As illustrated in FIG. 1, the length of fastener 34 lays along the top, horizontal edge from the left side to about the middle of the top edge of leg cover 20. FIG. 3 shows strap assembly 29*a* as it would appear when fastener 34 (not shown) and fastener 35 are joined.

It is seen from FIG. 1 that fastener 36 is attached to the upper, left-hand corner of shoe cover 22. The length of fastener 36 follows the left, vertical edge of shoe cover 22. This allows strap 29*b* to connect with fastener 36 when shoe cover 22 lays horizontally to cover the shoe top. FIG. 3 illustrates the bend created by seam 26. This bend in leg, ankle, and foot apparel protector 53 causes the vertical edges of shoe cover 22 to become horizontal when worn. Fastener 36 joins with the corresponding hook and loop material comprising fastener 37, which is attached to strap 29*b*. Fastener 36 should be about seven to eight centimeters long and about two centimeters wide.

Strap assemblies 29*a* and 29*b* can be seen in FIG. 1 and 2. Essentially, strap assemblies 29*a* and 29*b* are the same. However, strap 29*a* is slightly longer to accommodate the larger area of the leg it must wrap around. Strap 29*a* should be about twenty to twenty-two centimeters long and about two-and-a-half centimeters wide. Strap 29*b* should be approximately thirteen to fourteen centimeters long and about two-and-a-half centimeters wide.

FIG. 1 best illustrates the three elements making up both strap assemblies 29*a* and 29*b*. Strap 29*a* is comprised of an elastic strip 30, a material strip 31, and fastener patch 35. Elastic strip 30 should be about six to seven centimeters long and about two centimeters wide. This short strip of elastic is stitched to the upper right, horizontal edge of leg cover 20. The loose end of elastic strip 30 is sewn to material strip 31. When the two are so joined they form the full length of strap 29*a*. On the underneath side of material strip 31 is attached fastener 35. Fastener 35 should be about nine to ten centimeters long and about two centimeters wide. When properly formed, strap 29*a* will wrap around the back of a person's upper calf and connect fastener 35 to fastener 34. FIG. 3 shows strap 29*a* as it is employed around a leg.

Strap 29*b* is comprised of an elastic strip 32, a material strip 33, and fastener 37. Strap 29*b* is put together in the same fashion as strap 29*a*. Elastic strip 32 is sewn or attached to material strip 33. Fastener 37 is stitched to the underneath side of material strip 33 at the right-hand extremity of material strip 33. FIG. 1 shows strap 29*b* attached in an upward angle. The angle at which strap 29*b* is attached is approximately 45 degrees. The left edge of elastic strip 32 is attached to the right side of shoe cover 22 just below seam 26. The angle and placement of the lower strap assembly (29*b*) allows it to conveniently wrap around the back of the ankle and foot of the wearer in such a way that it connects properly with fastener 36.

From the description above and from an examination of FIG. 1 through 3, the leg, ankle, and foot apparel protector under consideration can be seen as having overcome the shortcomings of prior art. This present invention can be seen to be innovative and original in seeking to solve the problems associated with the particles thrown onto shoes and clothing by lawn and garden equipment. It contains features not found in previous devices. It protects portions of the wearer's apparel not considered by others. Further, it overcomes the difficulty associated with flying debris finding its way under the unsealed lower edges of devices found in prior art.

OPERATION—FIG. 1 to 3

The manner of using leg, ankle, and foot apparel protector 53 is simple. Each part works with the other parts to provide ample protection and a secure fit. Upper strap 29*a* is necessary to secure the upper section to a point just below the knee. Strap 29*a* wraps around the back of one's leg and fastens to hook and loop fastener 34 at the top of leg cover 20. Upper strap 29*a* is assured not to slip due to the shape of one's calf muscle. The elasticity in upper strap 29*a* allows for adjustment as well as a secure fit.

Lower strap 29*b* serves a dual purpose. It wraps around the back of the ankle and foot to hold the lower portion of the device against the ankle. The elasticity in strap 29*b* also creates tension on the front of the foot. This tension effectively holds toe pocket 25 onto the tip of one's shoe. The ability of toe pocket 25 to extend completely over the front tip of a shoe provides maximum protection for the entire top and sides of the shoe.

To wear, one easily pulls toe pocket 25 over the tip of the shoe. While applying light tension on toe pocket 25, lower strap 29*b* is wrapped around the back of the ankle and is fastened to hook and loop fastener 36. Finally, upper strap 29*a* is wrapped around the leg and secured to fastener 34. The hook and loop fasteners (34, 36, 35, and 37) allow for adjustment to provide a comfortable and secure fit. Removal is a simple matter of pulling both straps 29*a* and 29*b* free and lifting toe pocket 25 off of the shoe tip.

CONCLUSION, RAMIFICATIONS, AND SCOPE OF THE INVENTION

Thus the reader will see that the leg, ankle, and foot apparel protector herein described is a positive contribution to protective apparel. It provides a highly effective, economical, and easy to use device where previous attempts have fallen short or have been nonexistent.

While the above leg, ankle, and foot apparel protector contains many specifics, these should not be construed as limitations on the scope of the invention, but rather an exemplification of one preferred embodiment thereof. Many variations are possible. For example, the fasteners may be comprised of snaps, buttons, ties, etc.; the protector may come in a variety of colors and prints; it may be manufactured from any number of different materials, including paper, cloth, nylon, canvas, etc.; the sole may be made of multiple-plies or single-ply; the sole may be made out of leather, rubber, or any number of durable materials, natural or man-made; the device may be assembled by stitching, gluing, heat bonding, etc.; the protector may have an additional strap traveling under the instep for added security. This invention may be manufactured in many sizes to fit the needs of the many shapes and sizes of its users or in a one-size-fits-all design; changes may be made to the shape of this device to enhance its looks or to increase its effectiveness. For example, it may be widened to protect more area. The leg, ankle, and foot apparel protector may be manufactured as a right and left pair, or with both parts of the pair being identical. The straps may be made of fully elastic, fully material, or a combination of the two. In addition, applications beyond lawn and garden work are included.

Accordingly, the scope of the invention should be determined not by the embodiment illustrated alone but by the appended claims and their legal equivalent.

I claim:

1. An elongated leg, ankle, and foot covering comprising:

a. a generally rectangular piece of fabric of sufficient width and length to cover the front half of the lower leg of a wearer from just below the knee to the arch of the foot to cover leg apparel associated with the lower leg;

b. a tapered piece of fabric of sufficient width and length to entirely cover the shoe top and the shoe tip of a shoe of the wearer;

c. a half-moon shaped sole forming a toe pocket of sufficient dimensions for said toe pocket to fit over said shoe tip, said toe pocket functioning as a means of securing said tapered piece of fabric to said shoe tip, said toe pocket also functioning as a means of covering said shoe tip;

d. a means of securing said rectangular piece of fabric to a point just below the knee;

e. a means of securing said tapered piece of fabric to the ankle of the wearer, said means also adapted to apply tension on said toe pocket in order to secure it to said shoe top and said shoe tip;

whereby said elongated leg, ankle, and foot covering provides optimum protection for the apparel associated with the leg, ankle, and foot.

* * * * *